US007350591B2

(12) United States Patent
Wagner

(10) Patent No.: US 7,350,591 B2
(45) Date of Patent: Apr. 1, 2008

(54) DEVICE FOR PREVENTING AND EXTINGUISHING FIRES

(75) Inventor: Ernst Werner Wagner, Winsen Aller (DE)

(73) Assignee: Wagner Alarm-und Sicherungssysteme GmbH (DE)

( * ) Notice: Subject to any disclaimer, the term of this patent is extended or adjusted under 35 U.S.C. 154(b) by 110 days.

(21) Appl. No.: 10/574,733

(22) PCT Filed: Nov. 9, 2004

(86) PCT No.: PCT/EP2004/012669

§ 371 (c)(1),
(2), (4) Date: Apr. 6, 2006

(87) PCT Pub. No.: WO2005/044387

PCT Pub. Date: May 19, 2005

(65) Prior Publication Data

US 2007/0079973 A1 Apr. 12, 2007

(30) Foreign Application Priority Data

Nov. 10, 2003 (DE) ..... 103 52 437

(51) Int. Cl.
*A62C 35/00* (2006.01)
*A62C 3/00* (2006.01)
*A62C 37/36* (2006.01)
*A62C 35/02* (2006.01)

(52) U.S. Cl. ..... 169/11; 169/16; 169/48; 169/56

(58) Field of Classification Search ..... 169/11, 169/16, 48, 56, 5, 12, 43, 45, 46, 49, 54, 169/60, 61, 64
See application file for complete search history.

(56) References Cited

U.S. PATENT DOCUMENTS

| | | | | |
|---|---|---|---|---|
| 3,655,085 | A | 4/1972 | Aleck | |
| 5,857,525 | A | 1/1999 | Okamoto | |
| 6,390,203 | B1 | 5/2002 | Borisov | |
| 6,401,487 | B1 * | 6/2002 | Kotliar | 62/640 |
| 6,557,374 | B2 * | 5/2003 | Kotliar | 62/640 |
| 6,739,399 | B2 * | 5/2004 | Wagner et al. | 169/45 |
| 7,156,184 | B2 * | 1/2007 | Wagner | 169/45 |
| 2001/0029750 | A1 | 10/2001 | Kotliar | |

FOREIGN PATENT DOCUMENTS

| | | |
|---|---|---|
| DE | 19811851 | 9/1999 |
| DE | 19934118 | 2/2001 |
| DE | 10121550 | 8/2002 |
| EP | 1103286 | 5/2001 |
| EP | 1312392 | 5/2003 |
| WO | WO0157429 A1 | 8/2001 |
| WO | WO0178843 A3 | 10/2001 |

* cited by examiner

*Primary Examiner*—Darren Gorman
(74) *Attorney, Agent, or Firm*—Galbreath Law Offices, P.C.; John A. Galbreath

(57) ABSTRACT

A device for the prevention and extinguishing of fires is specified having the objective of providing an inert gas fire extinguishing system which is configured in accordance with the invention such that no breaches to ceilings or walls need be made when mounting the supply line system (4) during installation of the fire extinguishing system in a target area (1), and also having the further objective of dispensing with separate storage areas for the pressurized oxygen-displacing gas (3) used as extinguishing agent, wherein a buffer reservoir (2), the supply line system (4) and extinguishing nozzles (5) are arranged as a compact modular unit right within target area (1) itself.

32 Claims, 3 Drawing Sheets

DEVICE FOR PREVENTING AND EXTINGUISHING FIRES

Figure 1:
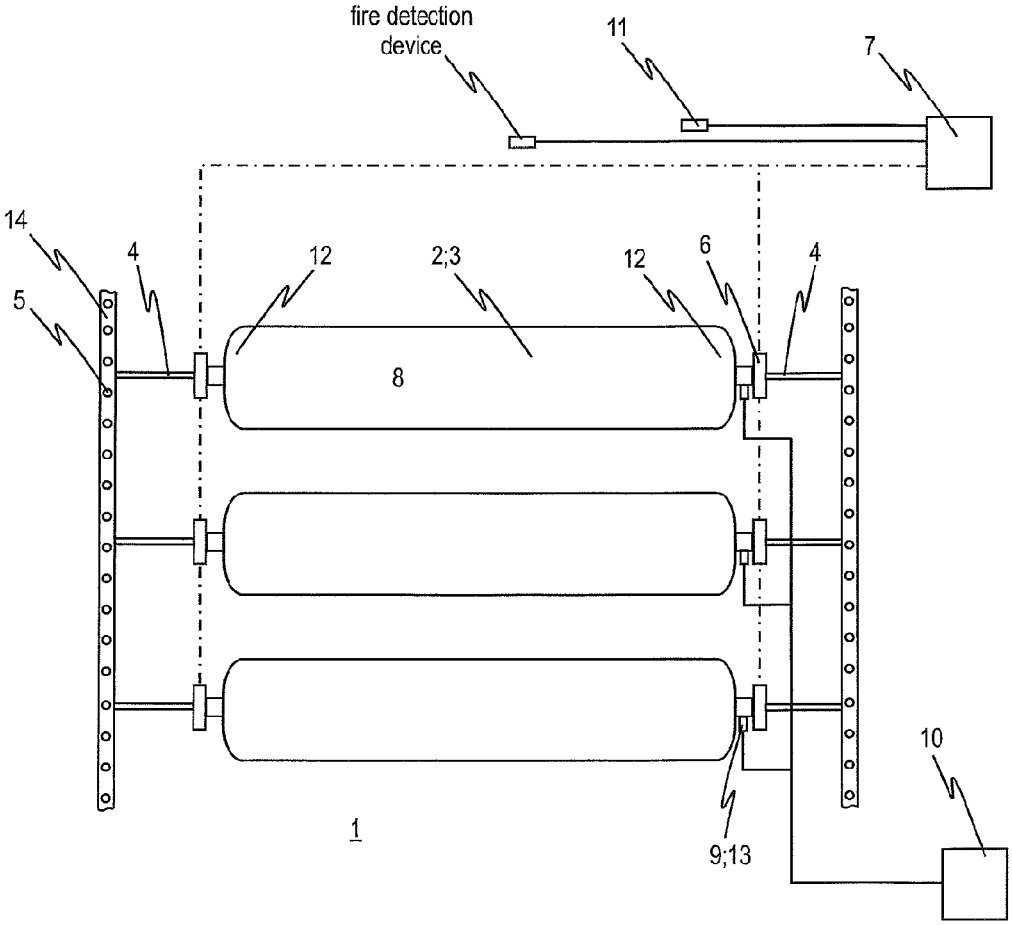

The present invention relates to a device for preventing and extinguishing fires in a closed spatial area or closed sections of a divisible spatial area, referred to as "target area" in the following, having a buffer reservoir in which oxygen-displacing gas is stored under high pressure, a supply line system which connects at least one extinguishing nozzle with the buffer reservoir by means of a pressure reducing valve, and a controller for controlling the pressure reducing valve in order to introduce the oxygen-displacing gas into the target area gradually as needed, or instantly in the event of fire, whereby one or more inert-rendered levels of reduced oxygen content in comparison to the natural state can be set in the target area.

Such a device is known in principle from the prior art, whereby the effect of so-called "inert gas extinguishing systems" as used in closed rooms, which are only entered occasionally by humans or animals, and the furnishings of which would sustain considerable damage should conventional extinguishing procedures (water or foam) be used, is based essentially on combating fire risk by lowering the oxygen concentration in the respective area to an average value of about 12% by volume, at which most inflammable materials no longer burn. Areas of application include EDP areas, electrical switching/wiring areas or storage areas containing economic goods of high value.

The extinguishing effect is thereby based on the principle of oxygen displacement. Normal ambient air consists of 21% oxygen, 78% nitrogen and 1% other gases. In an extinguishing process, for example by introducing pure nitrogen, further increasing the nitrogen concentration in a target area reduces the oxygen content. It is known that an extinguishing effect ensues when oxygen content drops below a value of 15% by volume. Depending upon the actual materials contained within the respective room, further lowering of the oxygen content to the cited 12% by volume or even lower may be necessary.

Normally applicable as oxygen-displacing gases are gases such as carbon dioxide, nitrogen, inert gases and mixtures thereof, which are usually stored in steel cylinders in special adjoining rooms or storage areas. However, to flood a target area with extinguishing gas, it has long been the case that substantial quantities of the extinguishing gas have needed to be stockpiled, in particular in the case of commercial premises such as open-plan offices and warehouses.

An example of an inert gas extinguishing system is known from U.S. Pat. No. 5,857,525, in which the oxygen-displacing gas is stored centrally in a gas vessel reserve bank, whereby the individual gas cylinders in the bank are connected with diverse extinguishing nozzles in the various different target areas by means of a corresponding system of pipes. A number of valves arranged between the respective gas vessels and the extinguishing nozzles are used to reduce the high pressure under which the inert gas is stored in the gas vessels (200 to 300 bar) down to 60 bar.

Since the fire extinguishing systems known from the prior art and based on the principle of inertization are usually of central design; i.e., configured so as to supply a plurality of target areas, the problem of storage inevitably arises because of the necessity of centrally storing substantial quantities of extinguishing gas. To this end, all the gas cylinders needed for the fire extinguishing system are usually stored centrally in a gas cylinder bank, for example in basement areas or other separate rooms. However, this gives rise to yet another problem, that being the considerable structural contingencies associated with laying the supply lines throughout the target areas, ultimately resulting in high installation and operating costs for the fire extinguishing system. Even retrofitting an existing building with this type of fire extinguishing system is coupled with formidable manufacturing and installation costs.

Other systems known from the prior art provide for centrally storing liquid-state gaseous fire extinguishing agent in a tank. Of additional substantial disadvantage to such systems is the losses in extinguishing agent occurring over time, since up to half the volume of an extinguishing agent can escape within a year. In addition to the tank and a cooling unit, a vaporizer is also required in order to restore the gaseous state of the fire extinguishing agent. This only increases the total system costs.

A solution known from the prior art and disclosed in DE 101 21 551 A1, for example, provides for circumventing the storage problem by reducing the oxygen content in the target areas to a basic inertization level safe for living creatures of on average about 17% by volume. This thus reduces the quantity of extinguishing gas needed to be stockpiled for achieving the full inertization level of an oxygen concentration of below 15% by volume to prevent and/or extinguish fires, resulting in an improvement on the described storage problem, yet special areas still need to be set aside structurally for the gas cylinders and the structural expenditures in laying the supply lines invariably remain high.

A further, particularly acute objective is specifically seen in developing an effective fire-fighting device for controlling tunnel fires. For the sake of simplicity, the term "tunnel" as used in the following refers to all tunnel-like structures such as mine shafts, underground shelters or similar half-open areas. To date, tunnels have not usually been equipped with stationary extinguishing devices. Part of the reason for this is the relatively high costs of such stationary devices. There is also a problem of particular respect to tunnel systems of unknown fire materials which can fuel a fire within a tunnel. Methods known in the field involve providing tunnels with stationary extinguishing systems—similar to known sprinkler systems—which use water for cooling and extinguishing effect. Apart from the relatively high installation costs, however, another disadvantage to the known prior art extinguishing systems for fighting tunnel fires is the fact that using water to extinguish burning fires produces hot steam which can spread rapidly through a tunnel.

An inert gas fire extinguishing system for extinguishing tunnel fires is known from, for example, DE 19934118 B1. Same provides for compressed storage of the oxygen-displacing gases used in the inert gas extinguishing procedure within special storage vessels located in secondary rooms. When needed, the oxygen-displacing gas is then directed through the piping system and corresponding outlet nozzles in the respective tunnel section. As previously mentioned, this fire extinguishing system known from the art also has the disadvantage of requiring considerable structural expenditure to equip or retrofit a tunnel with such a fire extinguishing system because separate storage areas for the centrally-stored oxygen-displacing gas as well as a widely-branched supply pipe system is needed.

Based on the problem as defined above, the task which the present invention addresses is that of improving upon a device to prevent and extinguish fires in a closed spatial area or closed sections of a divisible spatial area of the type mentioned at the outset in the simplest and most economical way possible such that storage of the extinguishing gas stockpiled for extinguishing fires does not necessitate the normally required special separate areas and that, in particular, the high structural expenditure associated with laying the supply pipe system can be significantly reduced.

A further task of the present invention is providing a fire extinguishing system specially designed for tunnels or tunnel-like structures which does not require special areas to store an extinguishing gas nor an elaborate and thus costly system of supply pipes.

In terms of the device, the task is solved by a device for preventing and extinguishing fires in a closed target area or closed sections of a divisible target area of the type indicated at the outset in that a buffer reservoir is configured as a high-pressure pipe having a compressive strength of ≧200 bar and that said high-pressure pipe has a connection to the supply line system at least at one head end section.

The solution according to the invention exhibits a full gamut of substantial advantages over the known fire extinguishing technology and above-described devices. Firstly, the inventive device for preventing and extinguishing fires, also referred to in the following for the purpose of simplification as simply "fire extinguishing system," does not require a separate buffer reservoir/gas cylinder stockroom to store the oxygen-displacing gas at high pressure since according to the invention, the oxygen-displacing gas is no longer stored centrally in a reserve cylinder bank supplying a plurality of target areas but is rather stored locally or directly adjacent the target areas. It is thus conceivable, for example, to dispose the buffer reservoir either in or directly adjacent a hall serving as a target area, e.g. along the wall of the hall. In the case of a tunnel serving as the target area, it is conceivable to dispose the buffer reservoir within the tunnel, for example under an access road or in an adjacent service pipe. Moreover, when installing the fire extinguishing system according to the invention, there is no need to break through the ceilings or walls to install the respective supply pipe system connecting the fire extinguishing nozzles with the buffer reservoir. This affords a notably simple and in particular very economical realization of the fire extinguishing system, both as an initial installation as well as when retrofitting an existing building. In addition, the inventive arrangement of the buffer reservoir and the supply system together with an extinguishing nozzle as one compact module in the target area, which in the case of fire directly dissipates the expansion energy ensuing from expansion of the oxygen-displacing gas stored under high pressure in the buffer reservoir from the target area, thereby inducing a cooling effect, involves a further positive effect in terms of extinguishing a fire in the target area. The pressurized containers have a high pressure capacity (300-100 bar). Pipes designed as high-pressure pipes are currently available commercially in ready-made lengths of 6, 8 and 10 meters, they can be easily welded together to obtain any desired length. Also conceivable for the buffer reservoir would be using commercial 200 bar or 300 bar gas cylinders having a capacity of 80 or 140 liters, a diameter of 267 or 323.9 mm, and a wall thickness of 28 mm. Using standard commercial components which can be easily re-engineered into buffer reservoirs, high-pressure pipes respectively, allows for considerably reducing the costs of manufacturing such a fire extinguishing system. Of course, other embodiments for the buffer reservoir are also conceivable. In order to achieve further technical advantages, it is preferably provided to employ a high-pressure pipe which has a connection to the supply line system on at least one head end section as the buffer reservoir. The connection already provided on commercial gas cylinders can be readily converted in particularly simple fashion for purposes of the fire extinguishing system according to the invention. Yet also conceivable here would be for both head end sections of the high-pressure pipe to have a connection to the supply line system. This would then achieve a symmetrical arrangement to the fire extinguishing system which, because of the dual-sided connections to the supply line system, would allow the pressurized oxygen-displacing gas as stored to be released extremely fast into the target area when the need arises. Of course, other embodiments are just as conceivable here such as, for example, having more than two outlets to the supply line system when long high-pressure pipes are used as the buffer reservoir. In the latter case, distributing a plurality of outlets along the pipe would be conceivable.

The present invention is further based on the consideration that problems arise when centrally storing the extinguishing gas in special containers such as steel cylinders, which in turn need to be stored in special areas due to their weight and for safety reasons. Having the buffer reservoir be stored directly in the target area in accordance with the invention purposely eliminates the decentralized storage of the extinguishing gas serving a plurality of target areas in conventional fire extinguishing systems and thus reduces the supply area for an individual buffer reservoir to one or at least just a few target areas, whereby the overall size of the individual buffer reservoirs is likewise reduced considerably in comparison to the bank arrangement of steel cylinders of the known prior art systems. The usual problems associated with the weight of the steel cylinders are thereby eliminated such that it becomes conceivable to, for example, mount the individual buffer reservoirs to the ceiling or on the wall of the target area.

The configuration of the buffer reservoir, the supply line system and the extinguishing nozzles as one compact module encompasses the further advantage of rendering a complex and in particular branched and expanded supply line system superfluous, which clearly reduces the probability of leakage or leakage points occurring within the system of pipes. This increases the operational reliability of the overall fire extinguishing system and additionally greatly reduces the system's maintenance costs.

The present invention in particular offers the advantage that the supply line system, which connects the extinguishing nozzle(s) to the buffer reservoir, comprises a pressure reducing valve. Being able to integrate the pressure reducing valve into the supply line system at the point of transition from high pressure to low pressure results in there being no manufacturing costs for a separate flow control element or the related installation expenditures. The pressure reducing valve is controlled by the controller such that it opens when the need arises, which introduces the oxygen-displacing gas from the buffer reservoir into the target area. It is thereby possible to set one or more inertization levels of reduced oxygen content in comparison to the natural state in the target area.

The technical task underlying application of the invention is solved by using the fire extinguishing system according to the invention in a tunnel.

Using the fire extinguishing system according to the invention in a tunnel solves the known and previously-noted problems of the prior art which occur when using such known fire extinguishing systems. It would thus be conceivable, for example, to dispose the device according to the invention on the ceiling or the side walls of a tunnel. This would thereby achieve the equipping of a tunnel with an inert gas fire extinguishing system at particularly low structural expense. In preferred fashion, a control signal emitted with respect to an area to be rendered inert based on the tunnel's separated target areas, which includes the area of the tunnel affected by a fire, will effect the inventive fire extinguishing system to reduce the oxygen content to an inert volume.

The term "separation" primarily refers to a concentration barrier by means of which the tunnel can be divided into one or more areas in which the oxygen concentration (or inert gas concentration) differs from the other areas of the tunnel by the degree necessary to produce the fire-extinguishing effect.

Utilizing the inventive fire extinguishing system in a tunnel advantageously provides for cost-effectively equipping or retrofitting a tunnel with a particularly low-maintenance inert gas fire extinguishing system without any special structural expenditure.

Advantageous embodiments of the inventive device are set forth in the subclaims.

In a preferred embodiment of the inventive device for preventing and extinguishing fires, the high-pressure pipe consists of a fiber-reinforced composite and has a pressure capacity of 300 to 700 bar.

A particularly advantageous embodiment of the present invention consists of further disposing at least one mechanism on the buffer reservoir for filling or refilling oxygen-displacing gas into said buffer reservoir. Such a mechanism is thereby preferably arranged such that the buffer reservoir can be readily accessed from the outside in the mounted state of the fire preventing and extinguishing device, as for example manually connecting a supply line to the mechanism for filling and/or refilling the buffer reservoir. This thus makes for extremely user-friendly and simple maintenance of the inventive device.

In a preferred development of the latter embodiment, the fire preventing and extinguishing device exhibits an oxygen-displacing gas generator. This gas generator serves to build up the inert gas stored in the buffer reservoir and is connected to the buffer reservoir by means of the inventive mechanism for filling/refilling said buffer reservoir. This type of gas generator could be, for example, a membrane system, separating the air to produce oxygen-poor air containing approx. 0.5 to 5% by volume of trace oxygen. Such mechanisms are known in the art and will not be described in any greater detail here. While it is conceivable to arrange the gas generator directly in the target area, it is preferable to dispose the gas generator in a separate room in order to have this single gas generator be able to supply several buffer reservoirs in different target areas. Employing such a gas generator connected directly to the mechanism for filling/refilling the buffer reservoir reduces maintenance costs for the fire preventing and extinguishing device according to the invention by yet a further degree.

An advantageous embodiment of the present invention, although already known to some extent in fire-extinguishing technology, is for the controller to be further disposed with an oxygen sensor in order to measure the oxygen content in the target area and to regulate the volume of fire extinguishing agent to be supplied to the target area. An oxygen sensor as such serves to measure the oxygen content in the target area in that the oxygen sensor sends a measurement signal providing information on the set inertization level to the controller. The controller thereupon controls the pressure reducing valve(s) subject to the measurement signal delivered by the oxygen sensor. Introducing the oxygen-displacing gas into the target area thus enables a first basic inertization level of reduced oxygen content compared to the natural state to be set in the target area, whereby it is then possible to additionally set—gradually as needed or in the event of fire, immediately—a further reduced oxygen content of one or more differing inertization levels by further feeding oxygen-displacing gas into the target area. The device in accordance with the present invention is therefore suited to render single or multi-stage inertization to prevent and/or extinguish fires in a target area.

In a particularly preferred embodiment of the inventive device for preventing and extinguishing fires, the controller is further provided with a fire detection device, in particular an aspirative fire detection device. In preferred fashion, a control signal is sent from a fire detection device to the controller, by means of which allocating the source of the fire to one or more areas of a target area able to be rendered inert follows. To this end, a fire detection device known per se is provided, installed in the target area such that existing or incipient fires can be detected across an entire given area, and in the event of a fire being detected or imminent, a detector emits the control signal to trigger the fire preventing and extinguishing device in the relevant area.

An example of what the term "fire detection device" refers to would be, for example, an aspirative device which continuously sucks a representative volume of target room air out through a system of pipes by means of suction openings and feeds same to a detector for detecting fire parameters.

The term "fire parameter" is to be understood as a physical variable which is subject to measurable changes in the proximity of an incipient fire, e.g. ambient temperature, solid, liquid or gaseous content in the ambient air (accumulation of smoke particles, particulate matter or gases) or local background radiation. The fire detection device can, however, also consist of a fire detection cable known per se which is laid on the walls within a target area. In each case, the task of the fire detection device is to localize the source of a fire and to emit the control signal which triggers the fire preventing and extinguishing device as well as floods the area to be rendered inert with inert gas.

It is preferable for the oxygen-displacing gas to be a pure inert gas or a mixture of inert gases. Thus, particularly when monitoring premises containing highly inflammable materials, a particularly large potential of oxygen-displacing gas will be available for the greatest drop possible to the oxygen content of the target area's air.

The following will make reference to the drawings in describing preferred embodiments of the inventive device for preventing and extinguishing fires in a closed target area or closed sections of a divisible target area in greater detail.

Figure 2:
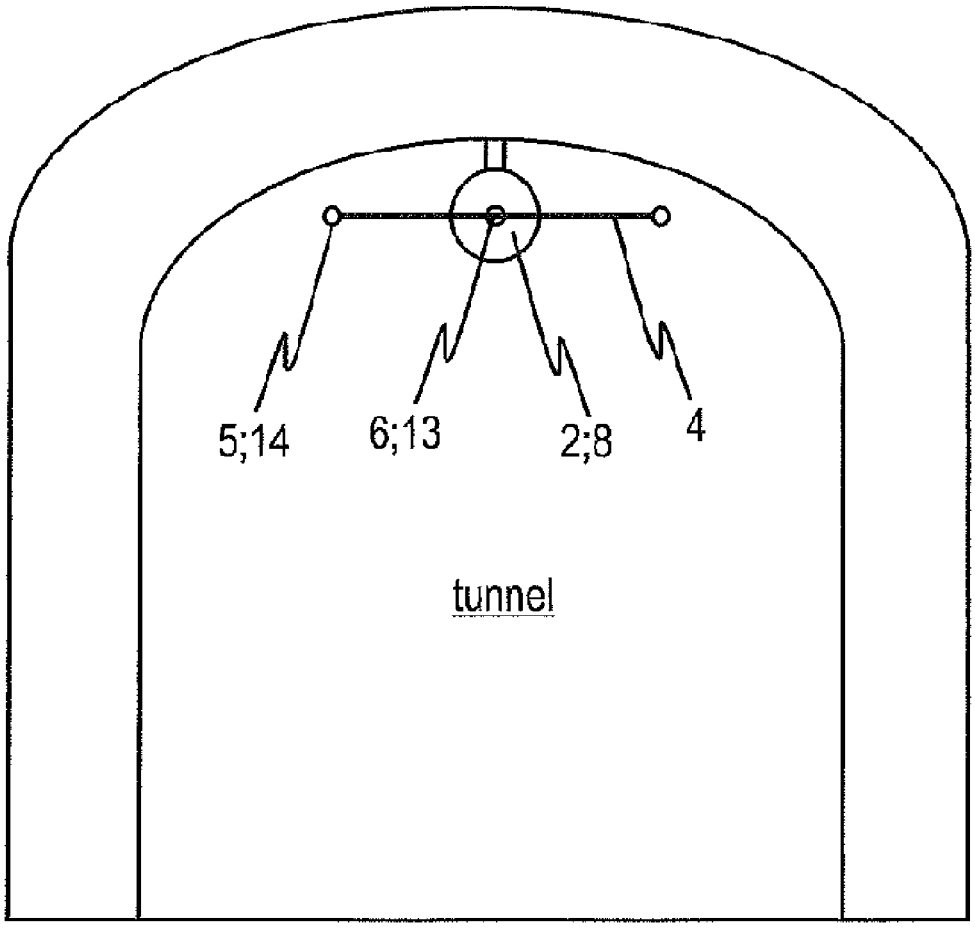
Figure 3:
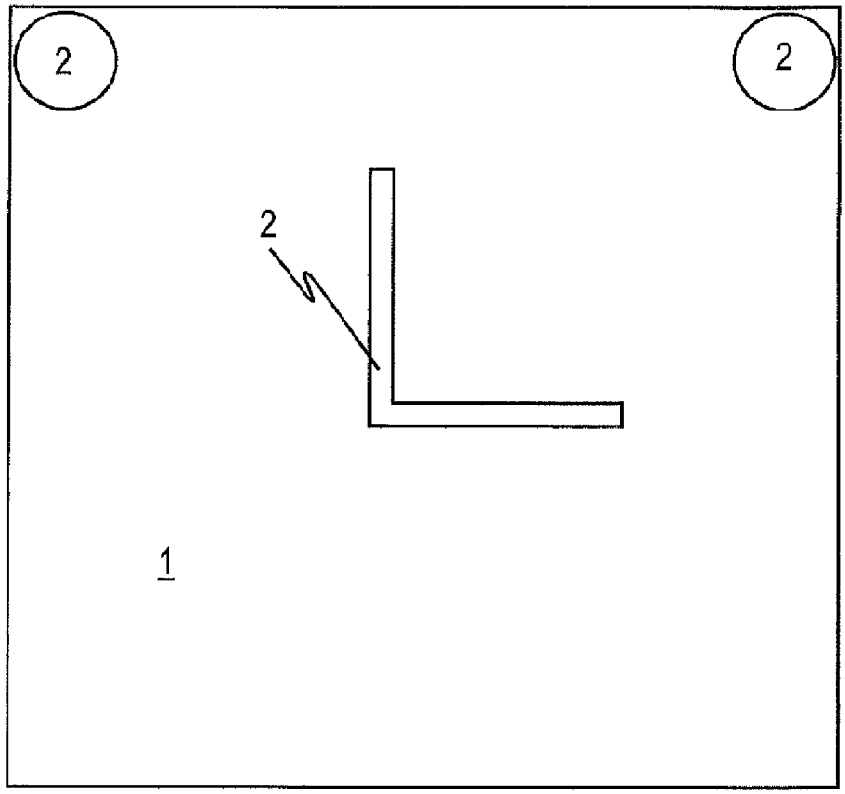

Shown are:

FIG. 1 a schematic representation of a preferred embodiment of the inventive device for preventing and extinguishing fires, FIG. 2*a, b* a schematic representation of a preferred embodiment of the inventive device for preventing and extinguishing fires in a tunnel, and FIG. 3 a schematic representation of a preferred embodiment of the inventive device for preventing and extinguishing fires in a target area.

FIG. 1 is a schematic representation of a preferred embodiment of the device according to the invention for preventing and extinguishing fires in a target area (1). As shown, the inventive fire extinguishing system in this embodiment exhibits three symmetrically-configured and parallelly-arranged buffer reservoirs (2), each configured in this embodiment as a high-pressure pipe (8). Each high-pressure pipe (8) exhibits a supply line system at its head end section (12). The supply line systems (4) are connected to the individual head end sections (12) of the respective high-pressure pipes (8) by means of pressure reducing valves (6).

The high-pressure pipes (8) serve to store an oxygen-displacing gas (3) which, in compressed state, is under a pressure of, for example, 300 bar. In the embodiment depicted in FIG. 1, buffer reservoir (2) is made from commercially-available 300 bar gas cylinders having a capacity of 140 liters. When producing such a buffer reservoir from in each case two gas cylinders, each is separated at its base and then welded together at the respective cut surfaces as prepared high-pressure pipe segments. This thus enables drawing on commercially-available components in order to produce the buffer reservoir (2), the high-pressure reservoir (8) respectively, for the fire extinguishing system according to the invention.

The pressure reducing valves (6) disposed on the respective head end sections (12) of the individual high-pressure pipes (8) are connected to a central controller (7). Said controller (7) serves to correspondingly control the individual pressure reducing valves (6) in order to allow the oxygen-displacing gas (3) stored under pressure in the respective high-pressure pipe (8) of the associated supply line system (4) to expand. The reciprocity between the controller (7) and the respective pressure reducing valves (6) is thereby configured such that the individual pressure reducing valves (6) can be partially or fully opened/closed.

As FIG. 1 shows, the respective supply line systems (4) from the left or right head end section (12) of the high-pressure pipes (8) each run to a left or right extinguishing nozzle panel (14) which in turn exhibits a plurality of extinguishing nozzles (5). When required; i.e., upon opened pressure reducing valves (6), the pressurized oxygen-displacing gas (3) stored in the respective high-pressure pipes (8) escapes through the supply line systems (4) and extinguishing nozzle panel (14) so that the gas (3) ultimately exits the individual extinguishing nozzles (5) and expands into target area (1). As the compressed gas (3) expands, heat energy dissipates from target area (1) such that target area (1) cools, which has a positive impact on fighting fire.

The oxygen-displacing gas (3) is preferably nitrogen or an inert gas. By using such an oxygen-displacing gas as an extinguishing agent, the fire extinguishing system according to the invention is particularly applicable in target areas (1) containing furnishings which would sustain substantial damage should conventional extinguishing agents be used, for instance water or foam. Areas of application include, for example, EDP areas, electrical switching/wiring areas or storage areas containing economic goods of high value.

Provided further in accordance with the invention is a high-pressure pipe (8) having at least one mechanism (9) for filling or refilling the respective high-pressure pipe (8) with the oxygen-displacing gas (3). This mechanism (9) enables simple checking of the fill level for the gas (3) stored in the individual high-pressure pipes (8), respectively refilling as needed.

In the preferred embodiment depicted in FIG. 1, a gas generator (10) is further provided to build up the gas (3) stored in the high-pressure pipe (8) and which fills the gas (3) stored in high-pressure pipe (8) by means of mechanism (9) for filling/refilling buffer reservoir (2). Said gas generator (10) can either be arranged within target area (1) itself or at a location external thereof.

As previously noted, controller (7) is connected to the individually-controlled pressure reducing valves (6). Said controller (7) comprises an internal processor (not shown) which transmits the appropriate commands to the individual pressure reducing valves (6) as a function of the readings from oxygen sensor (11) disposed in target area (1). Utilizing an oxygen sensor (11) which interacts directly with controller (7) allows the inventive fire prevention and extinguishing device to apply single or multi-stage inertization to target area (1). Oxygen sensor (11) thereby permanently monitors the oxygen content in target area (1).

With the device according to the invention and given the monitoring of the oxygen content in target area (1), it is thus possible to have, for example, an initial lowering to a specific basic inertization level of for example 16% by volume. This basic inertization serves in reducing the risk of a fire in target area (1). A basic inertization level of 16% by volume oxygen concentration presents no hazard whatsoever to people or animals such that same can still enter the room without experiencing any problems. A fire detection device, explicitly not shown in FIG. 1, which can, for example, be an aspirative fire detection device, continually monitors target area (1) to determine whether a fire has broken out or whether a fire is imminent. Said fire detection device interacts directly with controller (7) so that in the event of a fire, the oxygen content in target area (1) can be lowered to a certain full inertization level of, for example, 12% by volume or less. This full inertization level can either be set at night, when no person or animal will enter the respective target area (1), or as a direct response to a fire being reported. At 12 vol % oxygen concentration, the inflammability of most materials is already so low that they can no longer ignite.

Arranging the high-pressure pipes (8), the associated supply line system (4) and the extinguishing nozzles (5) as a compact module right inside target area (1) itself in accordance with the preferred embodiment of FIG. 1 reduces the total costs for the fire prevention and extinguishing system considerably. Moreover, there is no structural need to break through the ceiling or walls to mount the supply line systems (4).

FIG. 2 is a schematic representation of a further preferred embodiment of the inventive device for preventing and extinguishing fires which would be used in a tunnel. It is hereby provided for the buffer reservoir (2), configured as high-pressure pipe (8), to be equipped with an extinguishing nozzle panel (14) and extinguishing nozzles (5) disposed thereon from supply line system (4). The compact construction allows, for example, a tunnel without a fire extinguishing system to be equipped with an inert gas fire extinguishing system in a simple and particularly economical way, in particular without the need for external storage areas for the buffer reservoir (2).

FIG. 3 schematically shows how the preferred embodiment of the inventive device for preventing and extinguishing fires would be used within a hall area. Accordingly, it would be conceivable to arrange buffer reservoir (2) for example at the corner areas where a hall's wall and ceiling meet, whereby the (explicitly not shown in FIG. 3) supply line system (4) is laid in the hall (1) as needed. Buffer reservoir (2) is preferably a high-pressure pipe (8) having a diameter of 30-50 cm, whereby the pipes (8) can be arranged at arbitrary discretion. It would be conceivable, for example, to arrange high-pressure pipes (8), configured in U, S or L shape because of their weight, on the floor of the hall. Sinuous configurations are also conceivable. Arranging the high-pressure pipes (8) under the ceiling or on a wall of the hall is furthermore conceivable.

LIST OF REFERENCE NUMERALS

1 target area
2 buffer reservoir
3 oxygen-displacing gas
4 supply line system
5 extinguishing nozzle

6 pressure reducing valve
7 controller
8 high-pressure pipe
9 filling mechanism
10 gas generator
11 oxygen sensor
12 head end section
13 connection for supply line system
14 extinguishing nozzle panel

The invention claimed is:

1. Device for preventing and extinguishing fires in a closed target area or in closed sections of a divisible target area, having a buffer reservoir in which oxygen-displacing gas is stored under high pressure, at least one supply line system wherein each of said at least one supply line system connects at least one respective extinguishing nozzle with said buffer reservoir by means of a pressure reducing valve, and a controller for controlling said pressure reducing valve in order to introduce the oxygen-displacing gas into said target area gradually as needed, or instantly in the event of fire, wherein one or more inert-rendered levels of reduced oxygen content in comparison to the natural state can be set into said target area, wherein said buffer reservoir is configured as a high-pressure pipe having two opposite head sections and also having a compressive strength of ≧200 bar, whereby each head section of said high-pressure pipe has a connection to the respective supply line system.

2. Device in accordance with claim 1, wherein said high-pressure pipe consists of a fiber-reinforced composite.

3. Device in accordance with claim 2, wherein said high-pressure pipe has a pressure capacity of 300 to 700 bar.

4. Device in accordance with claim 1, wherein said buffer reservoir and said at least one supply line system are arranged as a compact module either in said target area itself or directly adjacent said target area.

5. Device in accordance with claim 2, wherein said buffer reservoir and said at least one supply line system are arranged as a compact module either in said target area itself or directly adjacent said target area.

6. Device in accordance with claim 3, wherein said buffer reservoir and said at least one supply line system are arranged as a compact module either in said target area itself or directly adjacent said target area.

7. Device in accordance with claim 1, wherein said buffer reservoir further comprises at least one mechanism for filling or refilling said buffer reservoir with oxygen-displacing gas.

8. Device in accordance with claim 2, wherein said buffer reservoir further comprises at least one mechanism for filling or refilling said buffer reservoir with oxygen-displacing gas.

9. Device in accordance with claim 3, wherein said buffer reservoir further comprises at least one mechanism for filling or refilling said buffer reservoir with oxygen-displacing gas.

10. Device in accordance with claim 4, wherein said buffer reservoir further comprises at least one mechanism for filling or refilling said buffer reservoir with oxygen-displacing gas.

11. Device in accordance with claim 7, wherein a gas generator is provided to build up the oxygen-displacing gas stored in buffer reservoir which is connected to buffer reservoir by means of said at least one mechanism.

12. Device in accordance with claim 8, wherein a gas generator is provided to build up the oxygen-displacing gas stored in buffer reservoir which is connected to buffer reservoir by means of said at least one mechanism.

13. Device in accordance with claim 9, wherein a gas generator is provided to build up the oxygen-displacing gas stored in buffer reservoir which is connected to buffer reservoir by means of said at least one mechanism.

14. Device in accordance with claim 10, wherein a gas generator is provided to build up the oxygen-displacing gas stored in buffer reservoir which is connected to buffer reservoir by means of said at least one mechanism.

15. Device in accordance with claim 1, wherein said controller is further provided with an oxygen sensor to measure the oxygen content in said target area and regulate the amount of the oxygen-displacing gas to be fed into said target area.

16. Device in accordance with claim 2, wherein said controller is further provided with an oxygen sensor to measure the oxygen content in said target area and regulate the amount of the oxygen-displacing gas to be fed into said target area.

17. Device in accordance with claim 4, wherein said controller is further provided with an oxygen sensor to measure the oxygen content in said target area and regulate the amount of the oxygen-displacing gas to be fed into said target area.

18. Device in accordance with claim 7, wherein said controller is further provided with an oxygen sensor to measure the oxygen content in said target area and regulate the amount of the oxygen-displacing gas to be fed into said target area.

19. Device in accordance with claim 11, wherein said controller is further provided with an oxygen sensor to measure the oxygen content in said target area and regulate the amount of the oxygen-displacing gas to be fed into said target area.

20. Device in accordance with claim 1, wherein said controller is further provided with a fire detection device.

21. Device in accordance with claim 2, wherein said controller is further provided with a fire detection device.

22. Device in accordance with claim 4, wherein said controller is further provided with a fire detection device.

23. Device in accordance with claim 7, wherein said controller is further provided with a fire detection device.

24. Device in accordance with claim 11, wherein said controller is further provided with a fire detection device.

25. Device in accordance with claim 15, wherein said controller is further provided with a fire detection device.

26. Device in accordance with claim 1, wherein said oxygen-displacing gas is a pure inert gas or a mixture of inert gases.

27. Device in accordance with claim 2, wherein said oxygen-displacing gas is a pure inert gas or a mixture of inert gases.

28. Device in accordance with claim 4, wherein said oxygen-displacing gas is a pure inert gas or a mixture of inert gases.

29. Device in accordance with claim 7, wherein said oxygen-displacing gas is a pure inert gas or a mixture of inert gases.

30. Device in accordance with claim 11, wherein said oxygen-displacing gas is a pure inert gas or a mixture of inert gases.

31. Device in accordance with claim 15, wherein said oxygen-displacing gas is a pure inert gas or a mixture of inert gases.

32. Device in accordance with claim 20, wherein said oxygen-displacing gas is a pure inert gas or a mixture of inert gases.

* * * * *